US008888092B2

(12) United States Patent
Hayayumi

(10) Patent No.: US 8,888,092 B2
(45) Date of Patent: Nov. 18, 2014

(54) SHEET FEEDING APPARATUS AND IMAGE FORMING APPARATUS

(71) Applicant: Canon Kabushiki Kaisha, Tokyo (JP)

(72) Inventor: Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/189,194

(22) Filed: Feb. 25, 2014

(65) Prior Publication Data

US 2014/0284874 A1 Sep. 25, 2014

(30) Foreign Application Priority Data

Mar. 22, 2013 (JP) ..... 2013-059837

(51) Int. Cl.

| | |
|---|---|
| ***B65H 1/14*** | (2006.01) |
| ***B65H 1/08*** | (2006.01) |
| ***B65H 1/04*** | (2006.01) |
| ***B65H 1/02*** | (2006.01) |

(52) U.S. Cl.

CPC .. *B65H 1/14* (2013.01); *B65H 1/04* (2013.01); *B65H 2405/11172* (2013.01); *B65H 1/025* (2013.01); *B65H 2405/1117* (2013.01)

USPC ..... 271/157; 271/127; 271/147

(58) Field of Classification Search

CPC .. B65H 1/14; B65H 1/025; B65H 2405/1117; B65H 2405/11172

USPC ..... 271/127, 147, 157, 10.13

See application file for complete search history.

(56) References Cited

U.S. PATENT DOCUMENTS

| | | | | |
|---|---|---|---|---|
| 5,470,052 | A * | 11/1995 | Asakawa et al. | 271/118 |
| 6,161,829 | A * | 12/2000 | Kusumi | 271/9.05 |
| 6,443,445 | B1 * | 9/2002 | Bortolotti | 271/117 |
| 7,681,877 | B2 * | 3/2010 | Won | 271/127 |
| 8,523,173 | B2 | 9/2013 | Hayayumi | |

FOREIGN PATENT DOCUMENTS

| | | | |
|---|---|---|---|
| JP | 2003-246468 | A | 9/2003 |
| JP | 2004-123308 | A | 4/2004 |
| JP | 3826049 | B2 | 9/2006 |

* cited by examiner

*Primary Examiner* — Patrick Cicchino

(74) *Attorney, Agent, or Firm* — Fitzpatrick, Cella, Harper & Scinto

(57) ABSTRACT

A sheet feeding apparatus and an image forming apparatus capable of ensuring reliability of meshing of gears at low cost are provided.

When a sheet feeding cassette is mounted to a printer body, a lifter gear provided to a lifter shaft of a lifter plate which lifts a sheet supporting plate is engaged with a first lifter idler gear, and the lifter gear is rotated by rotations of the first lifter idler gear by a drive of a lifter motor, and thereby the sheet supporting plate is lifted. And, displacement of the lifter gear is restricted by a load applied to the lifter gear by a restriction portion provided with an auxiliary support shaft which is provided to an opening portion formed in the lifter gear and the sheet feeding cassette to enter the opening portion when lifting the sheet supporting plate.

13 Claims, 8 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and particularly relates to a configuration for lifting and lowering a sheet stacking portion which stacks a sheet.

2. Description of the Related Art

A related art image forming apparatus such as a printer, a duplicator, or a facsimile machine has a sheet feeding apparatus which delivers a sheet stored in a sheet storage portion, which is provided detachably in the image forming apparatus body, by a sheet feeding unit to be fed to an image forming portion. An example of the sheet feeding apparatus is provided with a sheet stacking portion in the sheet storage portion to be lifted and lowered, and the sheet stacking portion is lifted when feeding a sheet to press the sheet against the sheet feeding unit thereby feeding the sheet. In the sheet feeding apparatus, the sheet stacking portion is lifted according to the sheet stacking amount by a lifter mechanism that is a lifting and lowing mechanism in order to keep the height of the uppermost sheet to a predetermined height at which sheet feeding is possible.

The image forming apparatus body is provided with a driving unit having a gear and a motor which drives the gear to drive the lifter mechanism, and when the sheet storage portion is mounted, the lifter mechanism is connected to the driving unit. Note that, when a user feeds a sheet or changes the kind of sheet, or sheet jam is occurred, the sheet storage portion is extracted from the image forming apparatus body so that the connection between the lifter mechanism and the driving unit is released. The sheet stacking portion is lowered when the connection is released.

FIG. 7 illustrates a configuration of this related art sheet feeding apparatus. A lifter gear 135 is connected via a lifter shaft 134 to a lifter plate 133 which lifts and lowers a sheet supporting plate 132 which is rotatably provided inside a sheet feeding cassette 130 about a fulcrum 132*a*. Then, when the sheet feeding cassette 130 is mounted, the lifter gear 135 is connected to a driving unit 144 having lifter idler gears 141, 142 and a lifter motor 143 provided to the image forming apparatus body (not illustrated). Thereby, when the lifter motor 143 is rotated, the lifter gear 135 meshed with the lifter idler gear 141 is rotated, and thereby the sheet supporting plate 132 is lifted via the lifter shaft 134.

In the related art, a sheet storage portion is required to enlarge capacity and deal with various sheets with high density. On the other hand, however, it also needs to satisfy a proposition called thinning, miniaturization and weight reduction aiming cost reduction. Further, in the lifter mechanism and the driving unit, it is required to improve reliability upon drive transmission against increase in the maximum number of stacked sheets and a load increased according to a request to feed a sheet with a large basis weight.

Therefore, in a the related sheet feeding apparatus, the lifter idler gears 141, 142 and the lifter gear 135 illustrated in FIG. 8A are high module gears with high rigidity respectively (see Japanese Patent Laid-Open No. 2003-246468). Additionally, as illustrated in FIG. 8B, there is a sheet feeding apparatus in which a boss 136 is provided to a sheet feeding cassette 131 and also an opening portion 145 is provided to a frame 146 of the image forming apparatus body. There, the boss 136 is engaged with the opening portion 145 near the lifter idler gears 141, 142 and the lifter gear 135 and also outside of a rotation range K of the lifter gear 135 so that the gears are properly meshed with each other at a high load as well (see Japanese Patent Laid-Open No. 2004-123308).

However, in such a related art sheet feeding apparatus, even when the lifter idler gears and the lifter gear are high module gears, the frame 146 and the lifter shaft 134 supporting them are sometimes deformed at a high load. Especially, in a product from which weight and thickness are reduced, there is a risk that the lifter shaft 134 is inclined in the width direction orthogonal to the sheet feeding direction or bent downward at a high load, and thereby proper meshing between the gears may be impaired.

And also, in a configuration that the boss 136 is engaged with the frame 146, the opening portion 145 needs to be formed outside of the rotation range K of the lifter gear 135. However, a location in which the boss 136 and the opening portion 145 are formed may be restricted due to a configuration of the frame 146 or the sheet feeding cassette 131. Therefore, reliability of meshing between the gears needs to be ensured with an additional cost for metalizing the lifter shaft 134 and the frame.

Then, the present invention is made considering such a situation so as to provide a sheet feeding apparatus and an image forming apparatus capable of ensuring reliability of meshing between gears at low cost.

SUMMARY OF THE INVENTION

A sheet feeding apparatus of the present invention includes a sheet storage portion which is provided to an apparatus body to be drawably mounted on the apparatus body and has a sheet stacking portion capable of lifting and lowering on which a sheet is stacked, a driving portion which is provided to the apparatus body and has a driving gear and a drive source connected to the driving gear, a lifting and lowering portion which is provided to the sheet storage portion and has a rotating member capable of rotating in a direction that the sheet storage portion is lifted, and a lifting and lowering gear provided to a rotation shaft of the rotating member and meshed with the driving gear when the sheet storage portion is mounted to the apparatus body, and a restriction portion which restricts a displacement of the lifting and lowering gear due to a load applied to the lifting and lowering gear when a driving force from the drive source is transmitted to the lifting and lowering gear from the driving gear.

According to the present invention, reliability of meshing of gears can be ensured at low cost by restricting displacement of the lifting and lowering gear due to a load applied to the lifting and lowering gear by the restriction portion which restricts the displacement of the lifting and lowering portion when lifting the sheet stacking portion.

Further features of the present invention will become apparent from the following description of exemplary embodiments with reference to the attached drawings.

DESCRIPTION OF THE EMBODIMENTS

Figure 1:
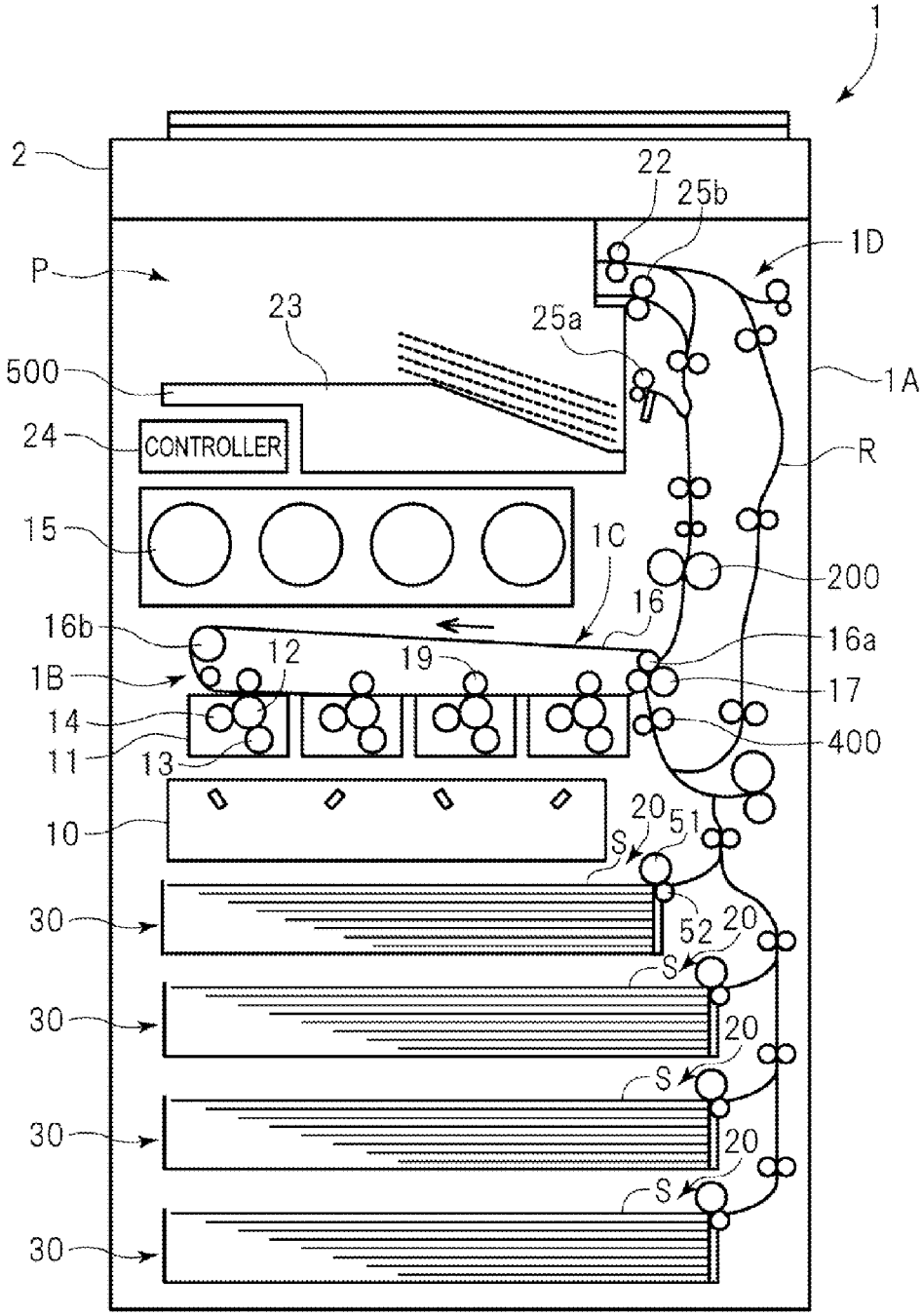
FIG. 1 is a schematic diagram illustrating a full-color laser beam printer which is an example of the image forming apparatus having a sheet feeding apparatus according to a first embodiment of the present invention.

Embodiments for carrying out the present invention will be described in detail hereunder with reference to the drawings. FIG. 1 is a schematic diagram illustrating a full-color laser beam printer which is an example of the image forming apparatus having a sheet feeding apparatus according to a first embodiment of the present invention.

In FIG. 1, a full-color laser beam printer (hereunder, referred to as a printer) 1 includes a printer body 1A as an image forming apparatus body, and an image forming portion 1B which forms an image on a sheet. An image reading apparatus 2 is substantially horizontally deposed above the printer body 1A, a sheet discharge space P being formed between the image reading apparatus 2 and the printer body 1A. A sheet feeding apparatus 20 which feeds a sheet S from a sheet feeding cassette 30 as a sheet storage portion for storing the sheet S is disposed.

The image forming portion 1B is of a 4 drum-full-color system, having a laser scanner 10, and four process cartridges 11 which forms a four-color toner image of yellow (Y), magenta (M), cyan (C), and black (K). Note that each of the process cartridges 11 has a photosensitive drum 12, a charging device 13 as a charging portion, and a development device 14 as a development unit.

And also, the image forming portion 1B has an intermediate transfer unit 1C arranged above the process cartridge 11, and a fixing portion 200. Note that a toner cartridge 15 for supplying toner to the development device 14 is disposed. The intermediate transfer unit 1C has an intermediate transfer belt 16 wound around a driving roller 16*a* and a tension roller 16*b*, and a primary transfer roller 19 provided inside of the intermediate transfer belt 16 to abut on the intermediate transfer belt 16 in a position opposite to the photosensitive drum 12. Here, the intermediate transfer belt 16 is rotated in the arrowed direction by the driving roller 16*a* driven by a driving portion (not illustrated).

Then, each color toner image with the negative polarity on the photosensitive drum is multi-transferred on the intermediate transfer belt 16 in order by the primary transfer roller 19. A secondary transfer roller 17, which transfers a color image formed on the intermediate transfer belt on the sheet S, is provided in a position opposite to the driving roller 16*a* of the intermediate transfer unit 1C.

Moreover, a fixing portion 200 is arranged above the secondary transfer roller 17, a pair of first discharge rollers 25*a*, a pair of second discharge rollers 25*b*, and a double-side reverse portion 1D being arranged at an upper left portion of the fixing portion 200. The double-side reverse portion 1D is provided with a pair of reverse rollers 22 capable of rotating normally and reversely and a reconveyance passage R which conveys a sheet, whose one surface is provided with an image, to an image forming portion 1B again. Note that a controller 24 for controlling image forming operation of the image forming portion 1B and sheet feeding operation of the sheet feeding apparatus 20 is disposed.

Next, image forming operation of the printer 1 will be described. Firstly, when image information of an original is read by the image reading apparatus 2, the image information is subjected to image processing. Thereby, the image information is converted into an electrical signal and then transmitted to the laser scanner 10 of the image forming portion 1B. In the image forming portion 1B, the surface of the photosensitive drum 12, which is uniformly charged to a predetermined polarity and potential by the charging device 13, is exposed in order by a laser beam. Thereby, on the photosensitive drums of the respective process cartridges 11, electrostatic latent images of yellow, magenta, cyan and black are respectively formed in order.

After that, in addition to developing the electrostatic latent images by each color toner to visualize the same, respective toner images on the respective photosensitive drums are superimposed in order on the intermediate transfer belt 16 to be transferred by a primary transfer bias applied to the primary transfer roller 19. Thereby, toner images are formed on the intermediate transfer belt 16.

And also, the sheet S is delivered from the sheet feeding apparatus 20 in parallel with the toner image forming operation, and then slew feeding of the delivered sheet S is corrected by a pair of registration rollers 400, being transferred to a secondary transfer portion. Then, in the secondary transfer portion, the toner images are batch-transferred on the sheet S by a secondary transfer bias applied to the secondary transfer roller 17.

Next, the sheet S, on which the toner images are transferred is, conveyed to the fixing portion 200 where toner of each color is melted and mixed by receiving heat and pressure, thereby being fixed on the sheet S as color images. After that, the sheet S on which the images are fixed is discharged to the discharge space P by the pair of first discharge rollers 25*a* arranged downstream of the fixing portion 200 and stacked on the stacking portion 23 protruded on the bottom surface of the discharge space P.

Figure 2:
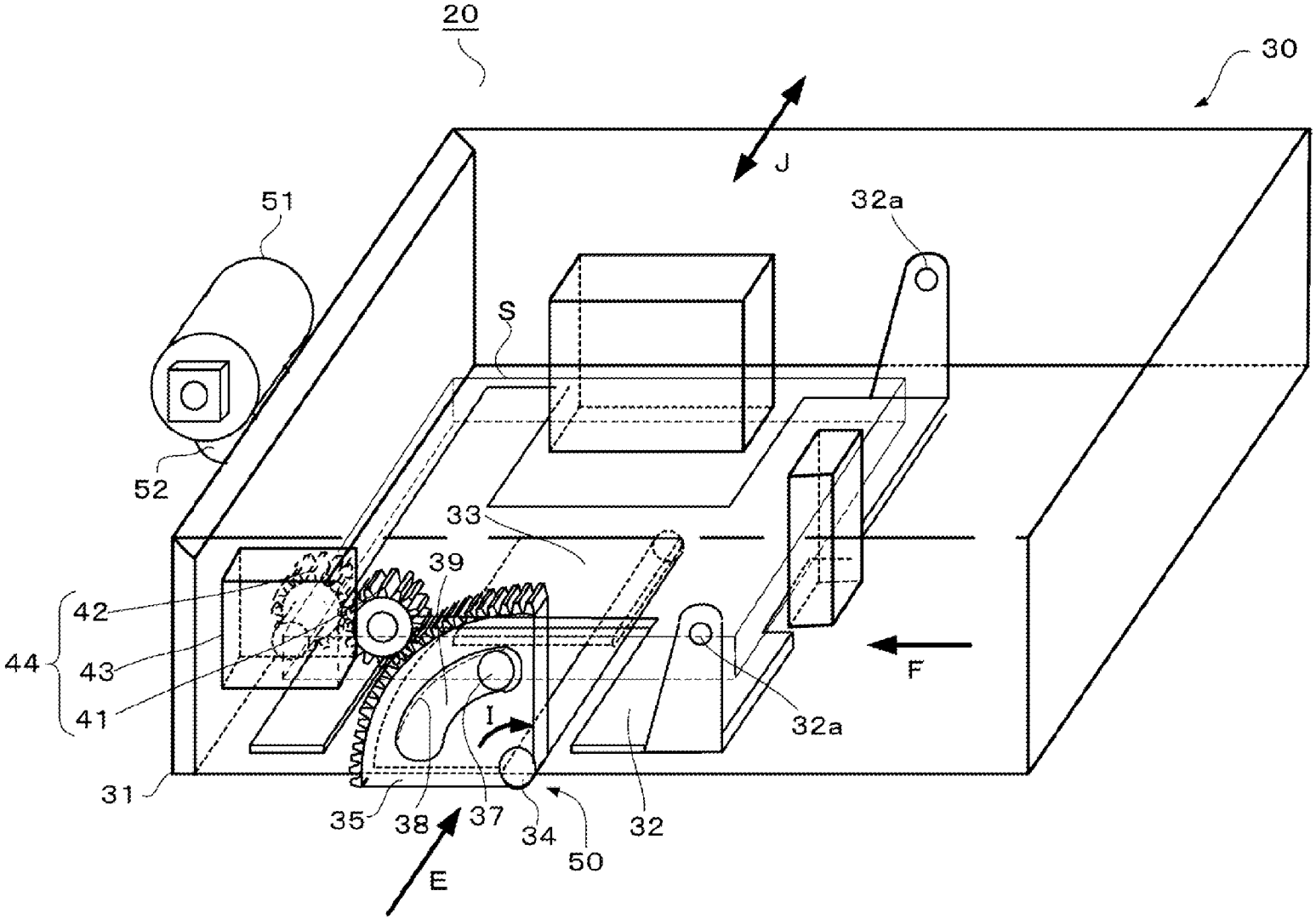
FIG. 2 is a diagram illustrating a configuration of the above-mentioned sheet feeding apparatus.

FIG. 2 is a diagram illustrating a configuration of the sheet feeding apparatus 20 according to the embodiment. In FIG. 2, there are provided a sheet feeding roller 51 as a sheet feeding unit which feeds the sheet S stored in the sheet feeding cassette 30, and a separation roller 52 which abuts on the sheet feeding roller to separate the sheet.

A sheet supporting plate 32 as a sheet stacking portion is provided rotatably (liftably/lowerably) in the vertical direction about a fulcrum 32*a* inside of the sheet feeding cassette 30 which is provided to be drawably mounted in the arrowed direction J with respect to the printer body 1A. There is provided a lifter plate 33 as a rotating member which is provided below the sheet supporting plate 32 and rotated in the vertical direction with a lifter shaft 34 as a rotation shaft as a fulcrum. The lifter plate 33 is integrally connected to the rotation center of a lifter gear 35 as a lifting and lowering gear by the lifter shaft 34, and when the lifter gear 35 is rotated, the lifter plate 33 is rotated about the lifter shaft 34 in the arrowed direction I to lift the sheet supporting plate 32. The lifter gear 35 is an arc-shaped gear (a fan-shaped gear). As stated above, in the embodiment, a lifter mechanism 50 which lifts the sheet supporting plate 32 with the lifter plate 33 and the lifter gear 35 is configured.

There is provided a driving portion 44 as a driving unit which lifts the sheet supporting plate 32 via the lifter mechanism 50. The driving portion 44 has a lifter motor 43 as a drive source provided to the printer body 1A which also serves as the sheet feeding apparatus body, a first lifter idler gear 41 and a second lifter idler gear 42 as driving gears driven by the lifter motor 43.

When the sheet feeding cassette 30 is mounted to the printer body 1A, the first lifter idler gear 41 and the lifter gear 35 are meshed with each other, and thereby the lifter motor 43 and the lifter mechanism 50 are connected to each other. Thereby, when the lifter motor 43 is rotated, driving force from the lifter motor 43 is transmitted to the lifter gear 35 via the first and second lifter idler gears 41, 42 so that the lifter gear 35 is rotated. And when the lifter gear 35 is rotated, the sheet supporting plate 32 is lifted via the lifter shaft 34 so that the sheet S on the sheet supporting plate 32 abuts on the sheet feeding roller 51.

Figure 3B:
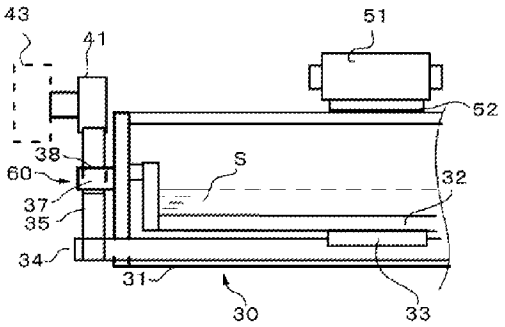
FIG. 3A to FIG. 3D are diagrams illustrating a state of the above-mentioned sheet feeding apparatus upon sheet feeding.
Figure 3D:
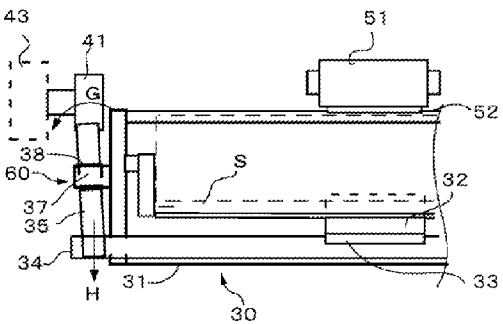
Figure 3A:
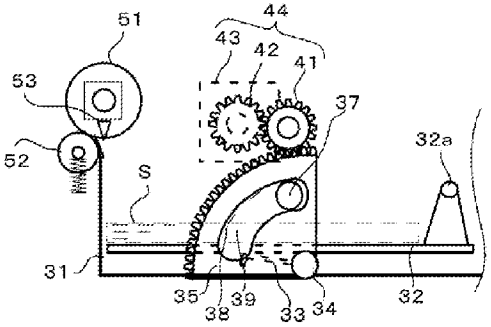
Figure 3C:
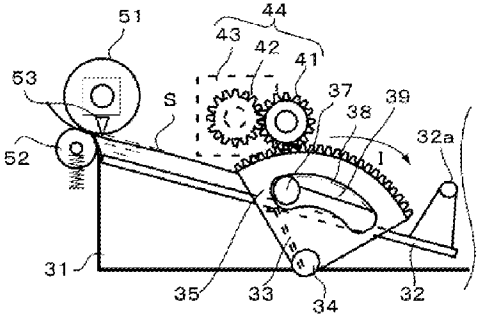

Note that the sheet feeding roller 51 is provided on the downstream side of the sheet feeding direction on the upper surface of the sheet S, and a sheet height detection sensor 53 is arranged near the sheet abutting position of the sheet feeding roller 51 as illustrated in FIG. 3A and FIG. 3C described later. And a controller 24 controls rotations of the lifter motor 43 to lift the sheet supporting plate 32 based on signals from the sheet height detection sensor 53. Note that, when sheets in the sheet feeding cassette 30 are run out and a sheet presence detection sensor (not illustrated), detects it, the controller 24 displays the notification of sheet supply on a panel.

Then, the user extracts the sheet feeding cassette 30 from the printer body 1A following the display to supply sheets. When the sheet feeding cassette 30 is pulled out from the printer body 1A, the meshing of the first lifter idler gear 41 and the lifter gear 35 is released, and thereby the sheet supporting plate 32 is lowered. Therefore, the sheets can be stacked on the sheet supporting plate 32.

Here, in the embodiment, as illustrated in FIGS. 3B and 3D, an auxiliary support shaft 37 protruded in the rotation range of the lifter gear 35 is provided on the outer wall surface on the downstream side of the insertion direction of the cassette body 31 of the sheet feeding cassette 30. Further, an opening portion 39 formed in an arc shape, which the auxiliary support shaft 37 enters, is formed on the lifter gear 35. An inner surface of the opening portion 39 is provided with an arc-shaped opening surface 38 with the lifter shaft 34 as the center thereon. The opening surface 38 is formed in such a dimension that the auxiliary support shaft 37 is contacted thereto when angles of the lifter gear 35 and the auxiliary support shaft 37 are about to change. Note that an inner surface opposed to the opening surface 38 in the opening portion 39 is also formed in an arc-shape with the lifter shaft 34 as the center thereof. Thereby, when the sheet feeding cassette 30 is detachably mounted to the printer body 1A, the sheet feeding cassette 30 is mounted to the printer body 1A in a state that the auxiliary support shaft 37 enters the opening portion 39 provided to the lifter gear 35.

Here, as illustrated in FIG. 3A, when the sheet supporting plate 32 is in a standby position before sheet feeding after being lowered, a load is not applied to the lifter gear 35. Therefore, as illustrated in FIG. 3B the lifter gear 35 is in a state of being orthogonal to the auxiliary support shaft 37. Note that, at this time, in the lifter gear 35, the auxiliary support shaft 37 is positioned in the upper end portion of the opening portion 39 as illustrated in FIG. 3A.

On the other hand, when the lifter motor 43 is driven in order to lift the sheet supporting plate 32 upon sheet feeding, the lifter gear 35 is rotated while moving the opening portion 39 along the auxiliary support shaft 37 to lift the sheet supporting plate 32, as illustrated in FIG. 3C. Here, when lifting the sheet supporting plate 32, a load is applied to the lifter gear 35 via the first and second lifter idler gears 41, 42. And when the load is applied, the lifter gear 35 is about to fall in the arrowed direction G illustrated in FIG. 3D, thereby being inclined, or be displaced in the arrowed direction H due to the rigidness of the lifter shaft 34 and the cassette body 31.

However, when the lifter gear 35 is about to be displaced as stated above, the opening portion 39 provided to the lifter gear 35 abuts on the auxiliary support shaft 37 from above to restrict the displacement of the lifter gear 35, as illustrated in FIGS. 3C and 3D. Namely, in the embodiment, a restriction portion 60, which restricts the displacement of the lifter gear 35 due to a load applied to the lifter gear 35 when lifting the sheet supporting plate 32 by the opening portion 39 formed in the lifter gear 35, and the auxiliary support shaft 37 which enters the opening portion 39, is configured. Additionally, by providing the restriction portion 60, reliability of meshing of the lifter gear 35 and the first lifter idler gear 41 can be ensured even when a load applied to the lifter gear 35 becomes larger.

As described above, in the embodiment, when lifting the sheet supporting plate 32, the displacement of the lifter gear 35 due to a load applied to the lifter gear 35 can be restricted by the restriction portion 60. Thereby, reliability of meshing of the lifter gear 35 and the first lifter idler gear 41 can be ensured even when a load applied to the lifter mechanism 50 becomes larger according to increase in the stacking amount of the sheet feeding cassette 30 and dealing with a high-density sheet. Namely, restricting the displacement of the lifter gear 35 by the restriction portion 60 makes it possible to ensure reliability of meshing of the lifter gear 35 and the first lifter idler gear 41 at low cost using a general synthetic resin material, without using an expensive metal component.

Figure 4A:
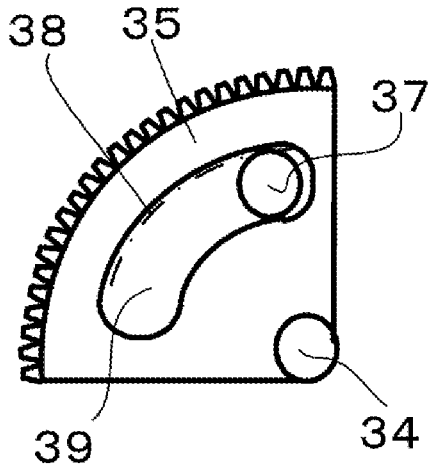
FIG. 4A and FIG. 4B are diagrams illustrating a form of an opening portion formed on a lifter gear provided to a lifting and lowering mechanism of the above-mentioned sheet feeding apparatus.
Figure 4B:
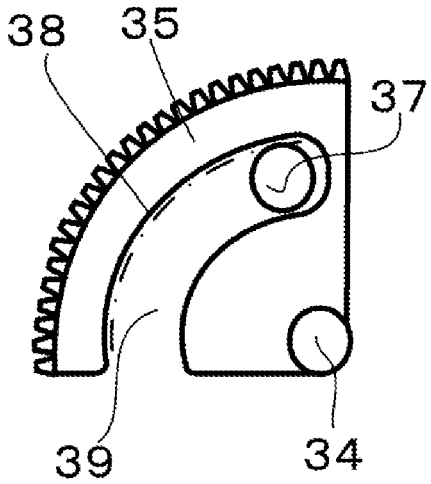

Note that, although in the embodiment the opening portion 39 provided to the lifter gear 35 is in an ark shape and in a closed hole shape having the opening surface 38 that the auxiliary support shaft 37 can be contacted therewith as illustrated in FIG. 4A, the present invention is not limited to the same. For example, the opening portion 39 may be in a cutout shape that the lower end thereof is opened, as illustrated in FIG. 4B. Also, the lifter gear 35 may be a circler gear, not an arc-shaped gear (a fan-shaped gear), and the opening portion 39 with the lifter shaft 34 as the center may be formed to the circular gear.

Figure 5A:
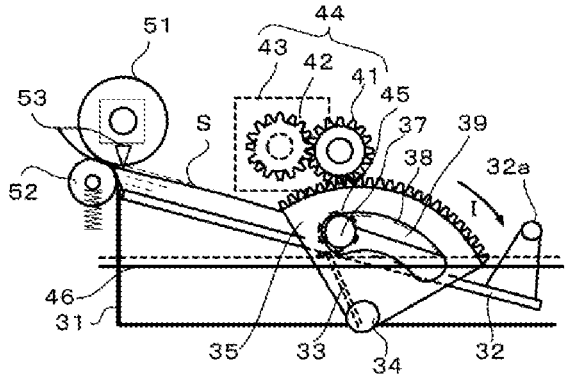
FIG. 5A and FIG. 5B are diagrams illustrating a configuration of a sheet feeding apparatus according to a second embodiment of the present invention.
Figure 5B:
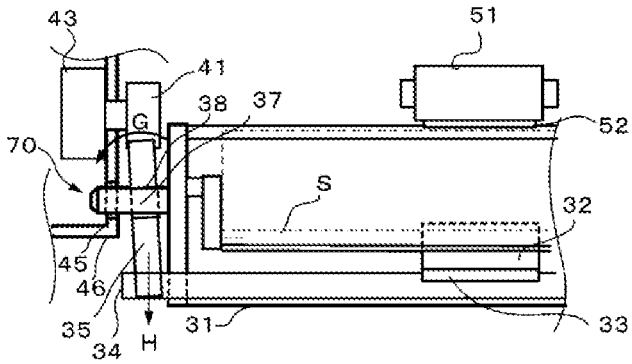

Next, the second embodiment of the present invention will be described. FIG. 5A and FIG. 5B are diagrams illustrating a configuration of a sheet feeding apparatus according to the embodiment of the present invention. Note that, in FIGS. 5A and 5B, the same signs as in the described FIGS. 3A to 3D illustrate the same or corresponding portions. In FIGS. 5A and 5B, a driving side plate (a body frame) 46, which supports the driving portion 44 having the lifter motor 43, the first and second lifter idler gears 41, 42, is provided to the printer body 1A. The driving side plate 46 is provided with a hole-shaped engaging hole 45 with which the tip end portion of the auxiliary support shaft 37 is engaged (fitted).

Here, in the embodiment, the auxiliary support shaft 37 has a length enabling the same to be engaged with the engaging hole 45 of the driving side plate 46 fixed to the printer body 1A when mounting the sheet feeding cassette 30 to the printer body 1A. Thereby, the auxiliary support shaft 37 enters the engaging hole 45 as a support portion when mounting the sheet feeding cassette 30 to the printer body 1A, and thereby the tip end portion of the auxiliary support shaft 37 is supported by the driving side plate 46.

In the embodiment, when mounting the sheet feeding cassette 30, the tip end portion of the auxiliary support shaft 37 enters the engaging hole 45 to be supported by the driving side plate 46. Thereby, the displacement of the lifter gear 35 when being driven by the driving portion 44 can be restricted more surely. As a result, reliability of meshing of the lifter gear 35 and the first lifter idler gear 41 can be ensured at low cost.

Note that, although the support portion is in a hole shape in the embodiment, it may be in a shape of pedestal supporting only the direction that the lifter gear 35 escapes. Also, when the auxiliary support shaft 37 and the engaging hole 45 are made to be fitted to each other, the sheet feeding cassette 30 can also be positioned to the printer body 1A. Namely, in the embodiment, the auxiliary support shaft 37 is fitted into the engaging hole 45, and thereby a positioning unit 70 which performs positioning of the sheet feeding cassette 30 to the printer body 1A is configured and also the positioning unit 70 can be provided within the rotation range of the lifter gear 35. Therefore, the driving side plate 46 can be configured small to save a space.

Note that, although the cassette body 31 is provided with the auxiliary support shaft 37 in the described first and second embodiments, the present invention is not limited to this and the auxiliary support shaft 37 may be provided to the driving side plate from the viewpoint of rigidness of the cassette body 31 and an occupied space.

Figure 6A:
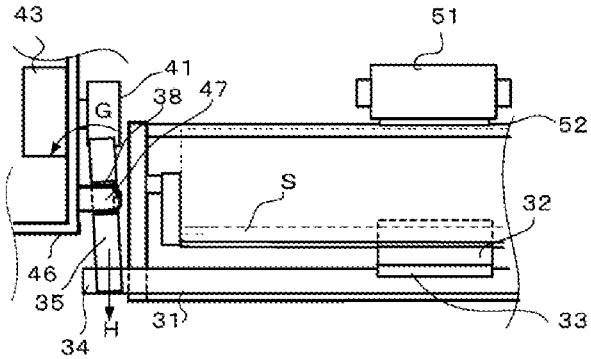
FIG. 6A and FIG. 6B are diagrams illustrating a configuration of a sheet feeding apparatus according to a third embodiment of the present invention.
Figure 6B:
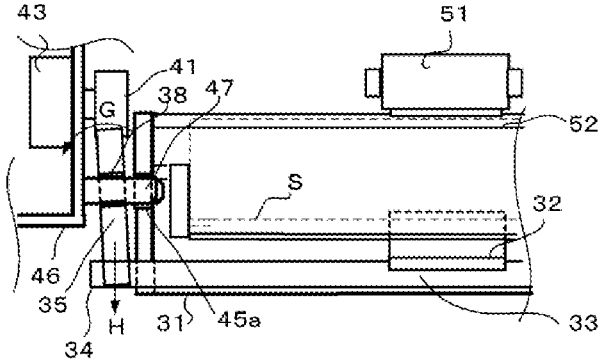
Figure 7:
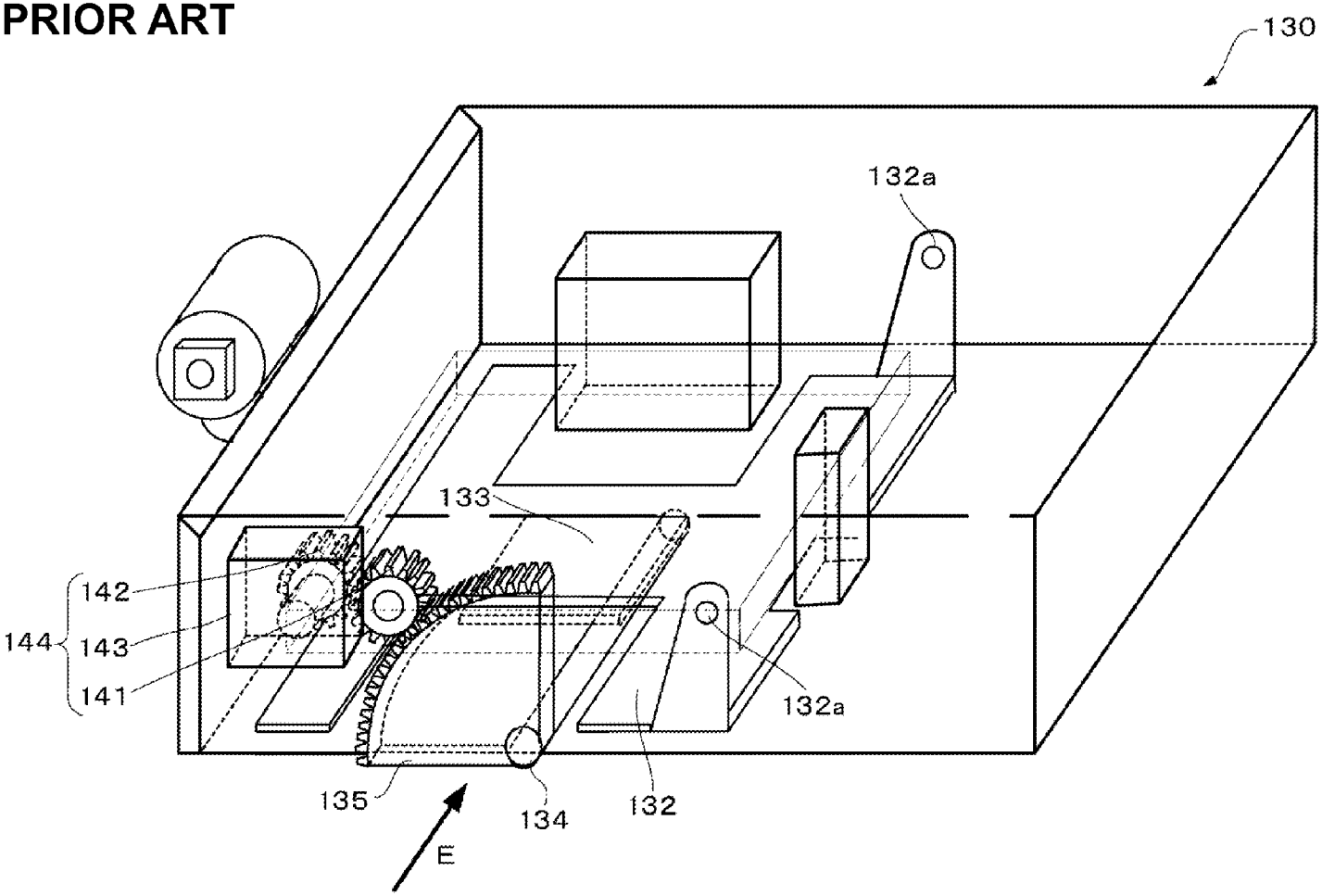
FIG. 7 PRIOR ART
FIG. 7 is a diagram illustrating a configuration of a the related sheet feeding apparatus.
Figure 8A:
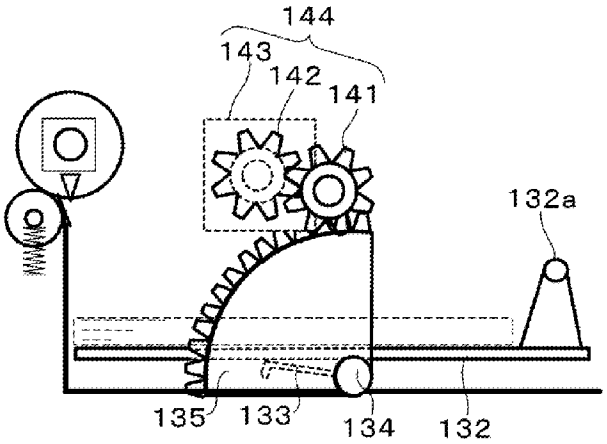
FIG. 8A PRIOR ART
FIG. 8A to FIG. 8C are diagrams illustrating a state of the related sheet feeding apparatus upon sheet feeding.
Figure 8C:
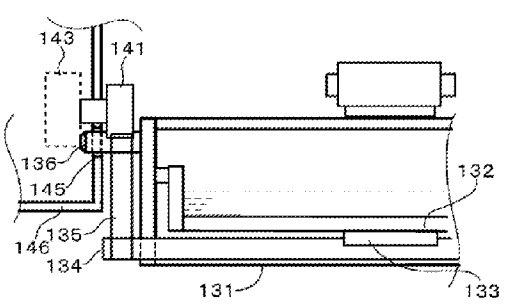
FIG. 8C PRIOR ART
Figure 8B:
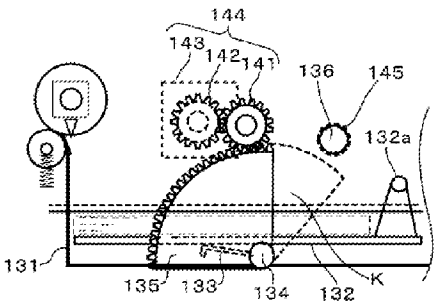
FIG. 8B PRIOR ART

Next, a third embodiment configured to provide such an auxiliary support shaft 37 to the driving side plate will be described. FIGS. 6A and 6B are diagrams illustrating a configuration of a sheet feeding apparatus according to an embodiment. Note that, in FIGS. 6A and 6B, the same signs as in the described FIGS. 5A and 5B illustrate the same or corresponding portions. In FIGS. 6A and 6B, an auxiliary support shaft 47 is provided to the driving side plate 46 to be in parallel to the lifter shaft 34 when the sheet feeding cassette 30 is mounted to the printer body 1A in the embodiment.

And, when mounting the sheet feeding cassette 30 to the printer body 1A, the auxiliary support shaft 47 provided to the driving side plate 46 enters the opening portion 39 provided to the lifter gear 35. Thereby, even when the lifter gear 35 is about to fall in the arrowed direction G illustrated in FIG. 5A to be inclined, or displaced in the arrowed direction H due to an increased load, the opening portion 39 of the lifter gear 35 abuts on the auxiliary support shaft 47 from above, and thereby the displacement of the lifter gear 35 can be restricted. As a result, reliability of meshing of the lifter gear 35 and the first lifter idler gear 41 can be ensured at low cost.

Note that, when the cassette body 31 is provided with an engaging hole 45*a* with which the tip end portion of the auxiliary support shaft 47 is engaged and the sheet feeding cassette 30 is mounted to the printer body 1A as illustrated in FIG. 5B, the auxiliary support shaft 47 may be fitted into the engaging hole 45*a* of the cassette body 31. Thereby, since the tip end portion of the auxiliary support shaft 47 is supported by the printer body 1A when mounting the sheet feeding cassette 30, the displacement of the lifter gear 35 can be prevented more surely. Additionally, positioning of the sheet feeding cassette 30 to the printer body 1A can be performed more surely.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-059837, filed Mar. 22, 2013, which is hereby incorporated by reference herein in its entirety.

What is claimed is:

1. A sheet feeding apparatus comprising:

a sheet storage portion which is drawably mounted to an apparatus body and has a sheet stacking portion capable of lifting and lowering, and on which a sheet is stacked;

a driving portion which is provided to the apparatus body and has a driving gear connected to a drive source;

a lifting and lowering portion which is provided to the sheet storage portion and has a rotating member capable of rotating in a direction such that the sheet storage portion is lifted, and a lifting and lowering gear provided to a rotation shaft of the rotating member and meshed with the driving gear when the sheet storage portion is mounted to the apparatus body; and a restriction portion which restricts a displacement of the lifting and lowering gear due to a load applied to the lifting and lowering gear when a driving force from the drive source is transmitted to the lifting and lowering gear from the driving gear.

2. The sheet feeding apparatus according to claim 1, wherein the restriction portion restricts an inclination of the lifting and lowering gear due to the load.

3. The sheet feeding apparatus according to claim 1, wherein the restriction portion has an arc-shaped opening portion formed in the lifting and lowering gear with the rotation shaft as a center of the opening portion and a support shaft which is provided to the sheet storage portion and slidably engaged with the opening portion to restrict the displacement of the lifting and lowering gear when the sheet storage portion is mounted to the apparatus body.

4. The sheet feeding apparatus according to claim 3, wherein the support shaft is fitted into an engaging hole provided in a frame of the apparatus body to position the sheet storage portion in the apparatus body.

5. The sheet feeding apparatus according to claim 1, wherein the restriction portion has an arc-shaped opening portion formed in the lifting and lowering gear with the rotation shaft as a center of the opening portion and a support shaft which is provided to the apparatus body and slidably engaged with the opening portion to restrict the displacement of the lifting and lowering gear when the sheet storage portion is mounted to the apparatus body.

6. The sheet feeding apparatus according to claim 5, wherein the support shaft is fitted into an engaging hole provided to the sheet storage portion to position the sheet storage portion in the apparatus body.

7. The sheet feeding apparatus according to claim 3, wherein the restriction portion has an arc-shaped opening portion formed in the lifting and lowering gear with the rotation shaft as a center of the opening portion and a support shaft which is provided to the sheet storage portion and slidably engaged with the opening portion to restrict the displacement of the lifting and lowering gear when the sheet storage portion is mounted to the apparatus body.

8. An image forming apparatus comprising:

an image forming portion which forms an image on a sheet; and a sheet feeding apparatus according to claim 1 which feeds a sheet to the image forming portion.

9. A sheet feeding apparatus comprising:

a sheet storage portion which is drawably mounted to an apparatus body and has a sheet stacking portion capable of lifting and lowering, and on which a sheet is stacked;

a driving portion which is provided to the apparatus body and has a driving gear and a drive source connected to the driving gear;

a rotating member which is provided to the sheet storage portion and capable of rotating in a direction that the sheet stacking portion is lifted;

a lifting and lowering gear which is provided to a rotation shaft of the rotating member and meshed with the driving gear when the sheet storage portion is mounted to the apparatus body;

an opening portion which is formed in the lifting and lowering gear by arc-shaped; and a support shaft which is provided to the apparatus body or the sheet storage portion and engaged with the opening portion of the lifting and lowering gear when the sheet storage portion is mounted to the apparatus body.

10. The sheet feeding apparatus according to claim 9, wherein the support shaft restricts an inclination of the lifting and lowering gear due to a load applied to the lifting and lowering gear when a driving force from the drive source is transmitted to the lifting and lowering gear from the driving gear.

11. The sheet feeding apparatus according to claim 9, wherein the support shaft is provided to the sheet storage portion, a frame of the apparatus body is provided with an engaging hole into which the support shaft can be fitted, and the support shaft is engaged with the engaging hole to perform positioning of the sheet storage portion when the sheet storage portion is mounted to the apparatus body.

12. The sheet feeding apparatus according to claim 9, wherein the support shaft is provided to a frame of the apparatus body, the sheet storage portion is provided with an engaging hole into which the support shaft can be fitted, and the support shaft is engaged with the engaging hole to perform positioning of the sheet storage portion when the sheet storage portion is mounted to the apparatus body.

13. An image forming apparatus comprising:

an image forming portion which forms an image on a sheet; and a sheet feeding apparatus according to claim 9 which feeds the sheet to the image forming portion.

* * * * *